US006519971B1

(12) United States Patent
Kim

(10) Patent No.: US 6,519,971 B1
(45) Date of Patent: Feb. 18, 2003

(54) ACCUMULATOR IN AIR CONDITIONER

(75) Inventor: Cheol Min Kim, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/714,979

(22) Filed: Nov. 20, 2000

(30) Foreign Application Priority Data

May 24, 2000 (KR) ..... 2000-28102

(51) Int. Cl.[7] ..... F25B 43/00; F25B 43/04
(52) U.S. Cl. ..... 62/503; 62/512; 62/475
(58) Field of Search ..... 62/494, 475, 503, 62/512, 84

(56) References Cited

U.S. PATENT DOCUMENTS 1,978,463 A * 10/1934 Kettering ..... 62/503
3,766,745 A * 10/1973 Quick ..... 62/196
5,347,817 A * 9/1994 Kim ..... 62/471
5,369,958 A * 12/1994 Kasai et al. ..... 62/158

FOREIGN PATENT DOCUMENTS

JP 404000168 A * 1/1992 ..... 62/503
JP 404139366 A * 5/1992 ..... 62/503
JP 404350479 A * 12/1992 ..... 62/503
JP 405296608 A * 11/1993 ..... 62/503

* cited by examiner

*Primary Examiner*—William C. Doerrler
(74) *Attorney, Agent, or Firm*—Birch, Stewart, Kolasch & Birch, LLP

(57) ABSTRACT

Accumulator in an air conditioner including a body having an inlet formed in a top portion thereof, first means fitted near to the inlet in the body for filtering contaminants, second means fitted under the first means for filtering oil, and an outlet tube for recovering oil stored in the body to a compressor, thereby preventing an unnecessary excessive operation of the compressors to improve an energy efficiency.

5 Claims, 4 Drawing Sheets

ACCUMULATOR IN AIR CONDITIONER

BACKGROUND OF THE INVENTION

1. Field of the Invention

The present invention relates to an air conditioner using two compressors, and more particularly, to an accumulator in an air conditioner for containing liquid refrigerant so as to permit flow of only gaseous refrigerant to a compressor.

2. Background of the Related Art

In general, the air conditioner controls a room temperature and humidity according to a required condition. As shown in FIG. 1, the air conditioner is provided with a compressor 1 for compressing refrigerant by using a rotating force, an outdoor heat exchanger 7 and an indoor heat exchanger 3 for condensing or evaporating the refrigerant by means of a heat exchange, and an expansion valve 5 for reducing a pressure of the refrigerant. And, there is an accumulator 6 connected to an inlet to the compressor.

In cooling the room by using the air conditioner, the refrigerant undergoes a refrigeration cycle, in which the refrigerant is compressed to a high temperature and pressure, condensed at the outdoor heat exchanger 7 by heat exchange, involved in a pressure drop as the refrigerant passes through the expansion valve 5, evaporated at the indoor heat exchanger 3 by heat exchange with room air, and provided to the compressor, again. The accumulator 6 has a body for storing the refrigerant, an inlet tube on a top of the body, and a U curved outlet tube. As the inlet of the accumulator is connected to an outlet of the indoor heat exchanger, and an outlet of the accumulator is connected to an inlet of the compressor, the refrigerant passed through the indoor heat exchanger flows into the accumulator, and separated into liquid phase refrigerant and a gas phase refrigerant by a difference of density, wherein the liquid phase refrigerant is stored in the body and only the gaseous refrigerant flows to the compressor through the outlet tube.

In the meantime, the aforementioned air conditioner has a poor air conditioning efficiency because the room cooling is carried out at a maximum rate even if no high cooling load is required, because the room air temperature is appropriate. FIG. 2 illustrates an air conditioner having two compressors of different compression capacities provided for solving the foregoing problem, provided with two compressors 1*a* and 1*b* of different capacities, for compressing a refrigerant, oil separators 2*a* and 2*b* for separating oil leaked from respective compressors, and oil recovery tubes 4*a* and 4*b* for recovering the oil separated at the oil separators to the compressor. Each of the oil separators 2*a* and 2*b* has flow path controlling means 8 for setting up a flow path to respective heat exchangers, so that the compressed refrigerant flows to the indoor heat exchanger and the outdoor heat exchanger 3 and 7 through the flow path controlling means 8. There is expansion valve 5 fitted between the heat exchangers for dropping a pressure of the refrigerant for an easy phase change of the refrigerant, and two accumulators 6*a* and 6*b* arranged to connect the flow path controlling means and the compressors for making only gaseous refrigerant to flow to the compressors among refrigerant flowing toward the compressors.

However, the air conditioner having two compressors is involved in a pressure drop since the high temperature, high pressure refrigerant from the compressors 1*a* and 1*b* passes through the oil separators 2*a* and 2*b,* which reduces a flow speed of the refrigerant flowing through the heat exchanger, that reduces a heat transfer efficiency. And, the use of the oil separators and the oil recovery tubes 4 cause the following many problems. The leakage of the oil carried on the refrigerant used for lubrication and prevention of overheat of the compressors during operation of the air conditioner causes trouble of the compressors. The additional use of oil separators for recovering the oil circulating through the air conditioner to the compressors increases cost, and makes the structure of the air conditioner complicated. And, many experiments and calculations are required for selecting a length of the oil recovery tubes 4, in general capillary tubes, which connect the compressors and the oil separators. The return of high pressure refrigerant to the compressors again through the oil recovery tubes 4 reduces a refrigerant flow rate circulating through the air conditioning cycle, which reduces the cooling and heating efficiency. Moreover, the easy adsorption of contaminants produced during operation of the air conditioner by the oil, difficulty of removal of the contaminants from the oil, and recovery of the contaminants at the recovery tubes together with the oil, results in blocking of the oil recovery tubes, which impedes recovery of the oil to respective compressors through the oil recovery tubes, to cause trouble on the compressors. Moreover, the provision of the oil separator and the accumulator to each compressor increases a weight of the air conditioner, makes a structure complicated, and pushes up a cost.

SUMMARY OF THE INVENTION

Accordingly, the present invention is directed to an accumulator in an air conditioner that substantially obviates one or more of the problems due to limitations and disadvantages of the related art.

An object of the present invention is to provide an accumulator in an air conditioner, in which a pressure drop of a high pressure refrigerant is prevented for improving cooling and heating efficiency.

Another object of the present invention is to provide an accumulator in an air conditioner, which can recover oil required for operation of a compressor to the compressor for prevention of out of order of the compressor, and simplify a system of the air conditioner.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the accumulator in an air conditioner includes a body having an inlet formed in a top portion thereof, first means fitted near to the inlet in the body for filtering contaminants, second means fitted under the first means for filtering oil, and an outlet tube for recovering oil stored in the body to a compressor.

The first means preferably includes a mesh with many holes for separating contaminants from refrigerant flowing in through the inlet, an edge of which is fixed to an upper portion of the body for separating contaminants from the refrigerant.

The second means preferably includes a screen having a plurality of circumferential pass through holes having an edge fixed to the body under the first means.

The outlet tube has a plurality of tubes each having one end positioned under the screen, the other end projected from the body, and an oil hole at a lower portion thereof.

The number of outlet tubes is the same with a number of compressor provided in a system.

In another aspect of the present invention, there is provided an air conditioner including a compressor for drawing, compressing, and discharging refrigerant to heat exchangers, a flow path controlling means for selecting a refrigerant flow path depending on cooling/heating condition, an outdoor heat exchanger connected between the flow path controlling means and an expansion valve which reduces a pressure of the refrigerant, for making heat exchange between the refrigerant and an external air, an indoor heat exchanger connected between the expansion valve and the flow path controlling means for making heat exchange between the refrigerant from the expansion valve and a room air, to evaporate the refrigerant, and an accumulator for receiving two phased refrigerant from the indoor and outdoor heat exchangers, separating gaseous refrigerant and oil from the two phased refrigerant flow, and letting the gaseous refrigerant and oil be flowed to the compressor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
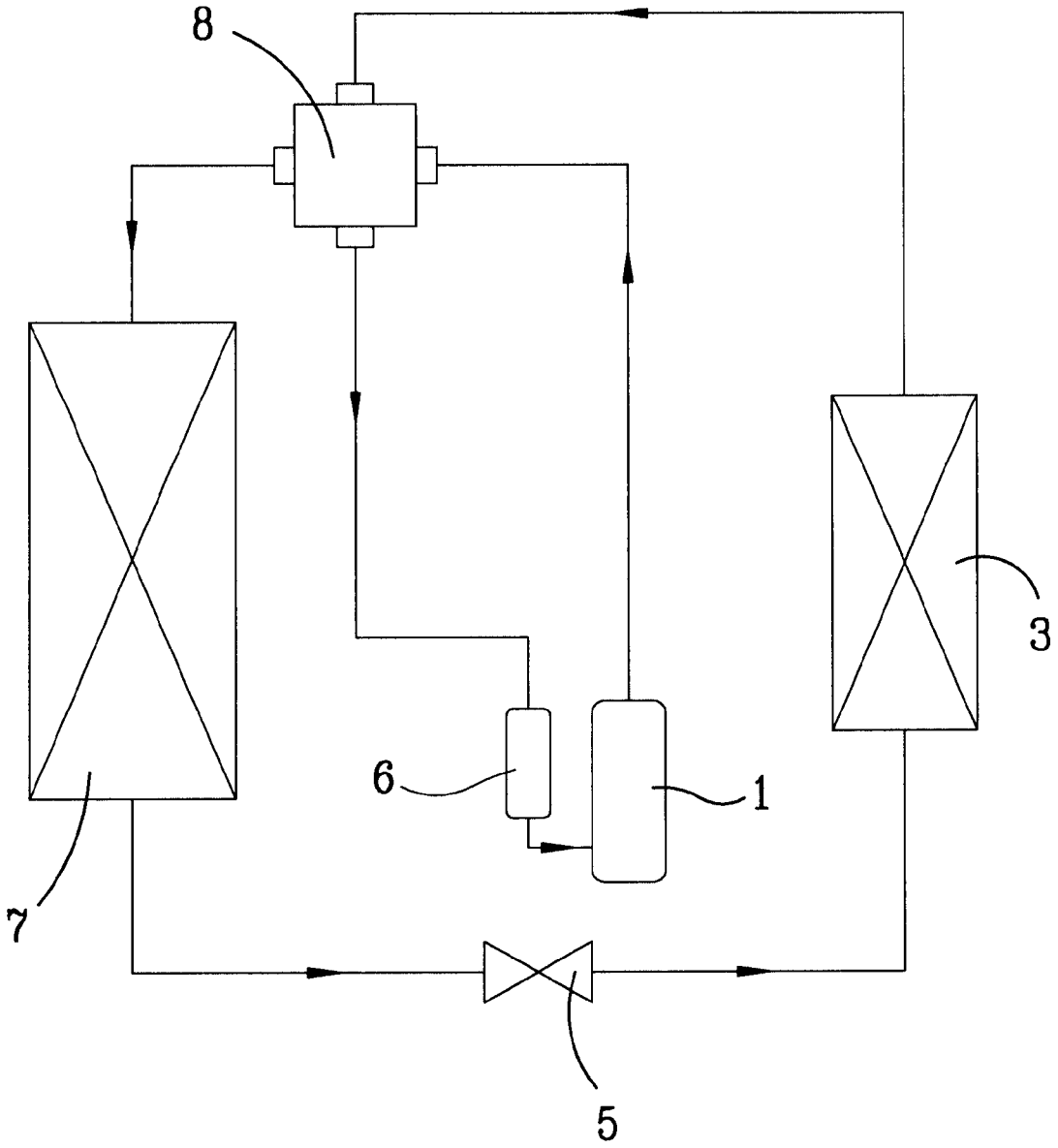
FIG . 1 Related Art
FIG. 1 illustrates a system of a related art air conditioner, schematically.
Figure 2:
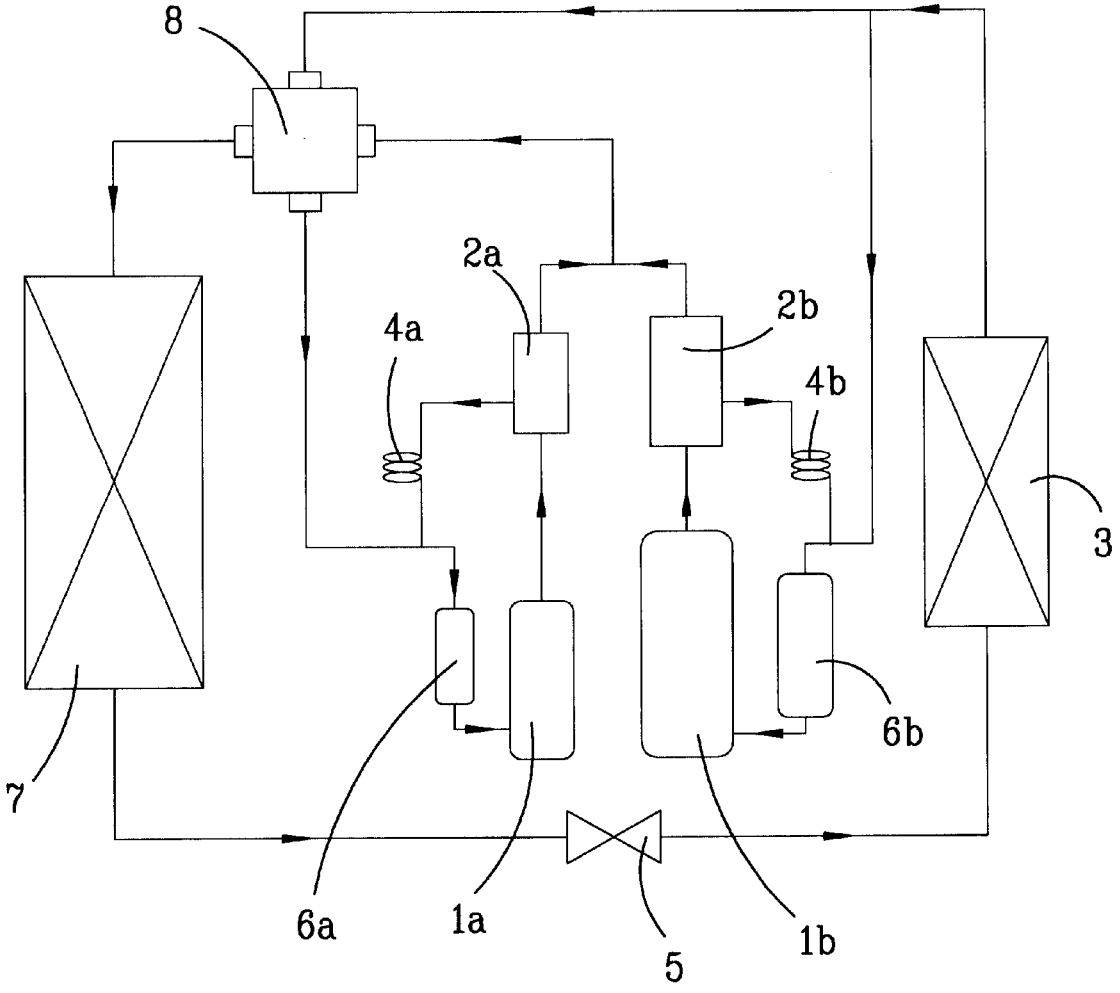
FIG . 2 Related Art
FIG. 2 illustrates a system of a related art air conditioner having two compressors, schematically.
Figure 3:
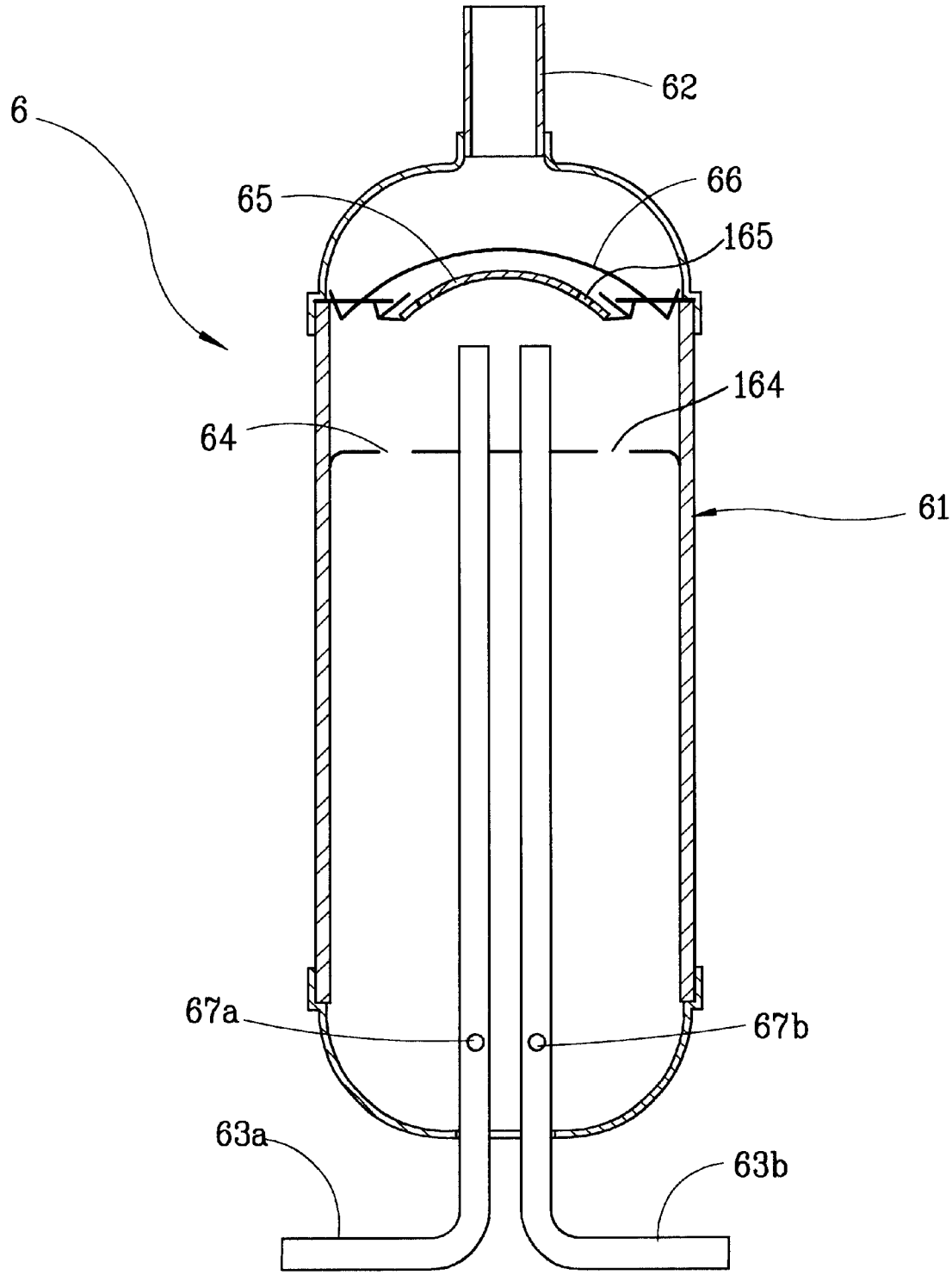
FIG. 3 illustrates a section showing an accumulator in accordance with a preferred embodiment of the present invention; and, FIG. 4 illustrates a system of an air conditioner having a plurality of compressors each with an accumulator in accordance with a preferred embodiment of the present invention, schematically.

Reference will now be made in detail to the preferred embodiments of the present invention, examples of which are illustrated in the accompanying drawings. FIG. 3 illustrates a section showing an accumulator in accordance with a preferred embodiment of the present invention.

Figure 4:
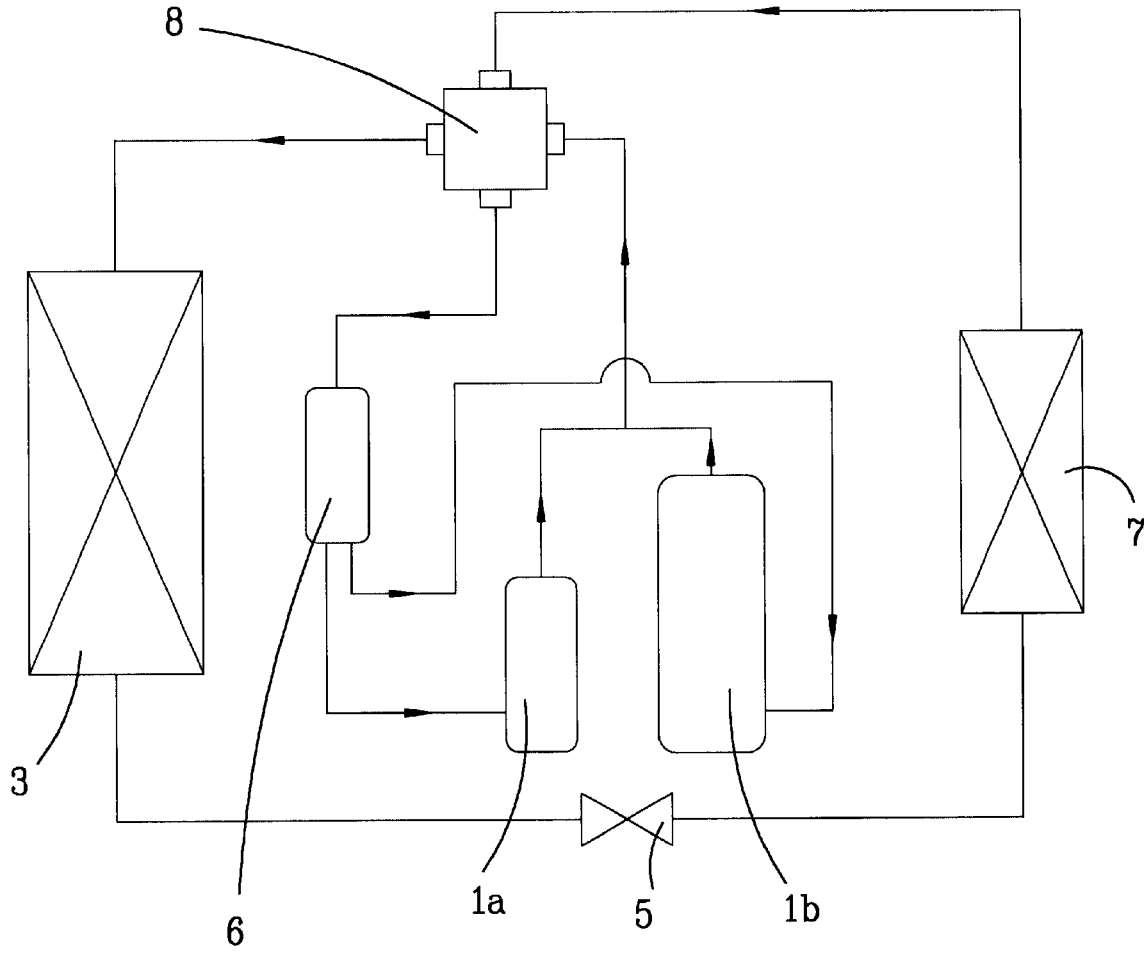

Referring to FIG. 4, the accumulator 6 in accordance with a preferred embodiment of the present invention includes a body 61, and an inlet 62 on a top of the body for entrance of refrigerant heat exchanged at a heat exchanger. And, there are outlet tubes 63*a* and 63*b* each having one end projected from a side opposite to the inlet 62 for connection to an inlet of a compressor. There is a mesh 66, a net, in an upper portion of the body 61 of which edge is held at holding metals, and a screen 65 under the mesh 66 having a plurality of pass through holes 165 in a circumferential direction formed therein held at the holding metals, too. There is a tube holder 64 of a circular plate fitted at a center of the body 61 having tube pass through holes(not shown) formed therein and liquid refrigerant pass through holes 164 formed therein. Each of the outlet tubes 63*a* and 63*b* has one end bent, projected from the body 61, and connected to one of the compressors, and the other end passed through the pass through hole in the tube holder 64. The outlet tubes may be provided as many as a number of compressors provided in a system, and each of the outlet tubes has a minute oil hole 67*a* and 67*b* in a lower portion thereof in the accumulator. The other end of the outlet tube is positioned in a central portion of the screen 65, such that the other end is not exposed to the circumferential pass through holes.

Thus, the accumulator 6 becomes to have an oil separation function additionally for recovering the oil leaked from the compressor to the compressor again, for prevention of oil circulation within a refrigerating cycle as the oil with a great thermal capacity deteriorates a heat exchange efficiency of the refrigerant, and increases a compression load of the compressor if the oil used for prevention of friction occurred at driving components of the compressor and absorbing a friction heat absorbs the refrigerant and circulates within the refrigerating cycle.

A system of the air conditioner of the present invention having the foregoing accumulator provided thereto will be explained. In this instance, there is only one outlet tube if the air conditioner has only one compressor.

In cooling operation of the air conditioner, the refrigerant, evaporated at the indoor heat exchanger and flowed in the accumulator, passes through the mesh 66 shown in FIG. 3, when the contaminants absorbed to the oil is filtered by the mesh, such that only the refrigerant and the oil pass through the mesh, and drop down through the circumferential pass through holes in the screen 65 under the mesh. In this instance, as a centrifugal force exerts to the refrigerant passing through the pass through holes in the screen 65, gaseous refrigerant does not drop down, but is recovered to the compressors through respective outlet tubes according to flow rates proportional to suction forces from the compressors. In the meantime, a mixture of the liquid refrigerant and the oil with great densities separated from the gaseous refrigerant is dropped down to a bottom of the accumulator 6 through the pass through holes 164 in the outlet tube holder 64, and the oil having a density greater than the liquid refrigerant deposits on the bottom of the accumulator and the liquid refrigerant stays on the oil. The oil separated thus from the liquid refrigerant is recovered by the suction force of the compressors to the compressors through minute oil holes 67 in lower portions of the outlet tubes 63 formed to permit pass of oil only. Thus, a performance of the compressors can be maintained as the oil can be recovered to the compressors without using the oil separators, separately.

FIG. 4 illustrates a system of an air conditioner having a plurality of compressors each with an accumulator in accordance with a preferred embodiment of the present invention, schematically.

Referring to FIG. 4, the air conditioner having a plurality of compressors each with an accumulator in accordance with a preferred embodiment of the present invention includes two compressors 1*a* and 1*b* each having a refrigerant compression capacity different from each other, flow path controlling means 8 having four ports for forming a path of the refrigerant formed to a high pressure at the compressors according to a cooling/heating mode, indoor/outdoor heat exchangers 7 and 3 each for receiving, and making heat exchange of the high pressure refrigerant under the control of the flow path control means 8 according to the cooling/heating mode, expansion valves 5 fitted between the indoor and outdoor heat exchangers, and an accumulator 6 having outlets 63 connected to respective inlets of the compressors.

The operation of the air conditioner will be explained, when the cooling is conducted by using an air conditioner having the foregoing accumulator and two compressors each with a refrigerant compression capacity different from each other, wherein a compressor having a smaller compression capacity will be called as a first compressor 1*a* and a greater compression capacity will be called as a second compressor 1*b*. Since a required cooling load is fixed according to a room air temperature to be cooled, if a required cooling capacity is smaller than a cooling capacity of the first compressor, the second compressor 1*b* is not operated, but the first compressor 1*a*. And, if the required cooling capacity is greater than the cooling capacity of the first compressor 1*a,* but smaller than the cooling capacity of the second compressor 1*b,* the first compressor is not operated, but the second compressor 1*b,* only. And, if the required cooling capacity is greater than the cooling capacity of the second compressor 1*b,* the first compressor 1*a* and the second compressor 1*b* are operated on the same time. In the case of the refrigerating cycle of operating both compressors 1*a* and 1*b,* the refrigerant compressed to a high temperature and a high pressure at the compressors 1*a* and 1*b* dissipates/absorbs heat to change phases by heat exchange with coolants as the refrigerant passes through the indoor heat exchanger 3 and the outdoor heat exchanger 7, and flows into the accumulator 6 through the inlet 62. The refrigerant in the accumulator 6 is involved in contaminant filtration adsorbed to the oil as the refrigerant passes through the mesh 66, and separation between gaseous refrigerant and liquid refrigerant since the refrigerant has a centrifugal force exerted thereto as the refrigerant passes through the circumferential pass through holes in the screen 65. Then, the gaseous refrigerant is drawn to the first compressor 1*a* and the second compressor 1*b* through respective outlet tubes 63 in flow rates proportional to suction forces of the compressors. Then, a mixture of liquid refrigerant and oil with great densities, separated from the gaseous refrigerant by the centrifugal force, drops down, and passes through the pass through holes in the outlet tube holder 64, and drops down to a bottom of the accumulator. In this instance, among the oil and the liquid refrigerant, the oil with a greater density than the refrigerant deposits on the bottom of the accumulator, and the refrigerant is disposed on the oil. The oil separated thus from the refrigerant in the foregoing process is recovered to the compressors by the suction force of the compressors through a minute hole 67 formed to pass oil only in a lower portion of the outlet tubes 63. Amounts of oil recovered to respective compressors are controlled in proportion to refrigerant flow rates to respective compressors.

Different from the above case, in the case when only one compressor is operated while the other compressor is not operated the gaseous refrigerant flows toward the operative compressor through the accumulator 6, and the oil is also drawn to the operative compressor through the oil hole 67 in the outlet tube 63 connected to the operative compressor.

In the meantime, in a heating by using the air conditioner, the selective operation of the compressors taking a required heating capacity according to a room temperature is the same with the case of cooling operation. If the two compressors are operated in the heating, the high pressure refrigerant compressed at the two compressors 1*a* and 1*b* flows into the indoor heat exchanger 7 through the flow path controlling means 8, condensed as the refrigerant dissipates heat, and flows into the accumulator 6 through the expansion valve 5 and the outdoor heat exchanger 3. The refrigerant, flowed into the accumulator 6, is involved in separation of gaseous refrigerant having a different density, which flows to the compressor, together with the oil deposited on the bottom of the accumulator through the oil holes 67 in the outlet tube 63, thereby establishing a heating cycle.

As has been explained, the accumulator in an air conditioner of the present invention has the following advantages.

The selective operation of the compressors depending on a cooling/heating load, an unnecessary excessive operation of the compressors can be prevented, which improves an energy efficiency. The regulation of refrigerant for two compressors by using one accumulator reduces a production cost. The removal of contaminants formed during use of the air conditioner from the refrigerant at the accumulator prevents out of order of the air conditioner, such as blocking of the tubes. And, the provision of an oil separation function to the accumulator without additional provision of expensive oil separator improves performance and reliability, and the elimination of requirement of separate oil separator provision permits an easy installation of the air conditioner and reduces volume and weight.

It will be apparent to those skilled in the art that various modifications and variations can be made in the accumulator in an air conditioner of the present invention without departing from the spirit or scope of the invention. Thus, it is intended that the present invention cover the modifications and variations of this invention provided they come within the scope of the appended claims and their equivalents.

What is claimed is:

1. An air conditioner comprising:

a plurality of compressors operative together or selectively depending on a required cooling/heating capacity for drawing, compressing, and discharging a refrigerant to heat exchangers;

a flow path controlling means for selecting a refrigerant flow path depending on a cooling/heating condition;

an outdoor heat exchanger connected between said flow path controlling means and an expansion valve which reduces a pressure of the refrigerant, for facilitating heat exchange between the refrigerant and a supply of external air;

an indoor heat exchanger connected between the expansion valve and said flow path controlling means for facilitating heat exchange between the refrigerant from the expansion valve and ambient air and evaporating the refrigerant; and, an accumulator for receiving a two phased refrigerant from the indoor and outdoor heat exchangers, separating gaseous refrigerant and oil from the two phased refrigerant flow, and permitting a flow of the gaseous refrigerant and oil to the compressors, said accumulator including a body having an inlet formed in a top portion thereof, said inlet connecting the flow path controlling means;

first means for filtering oil from contaminants being fitted near to the inlet in the body;

second means for separating the gaseous refrigerant from liquid refrigerant being fitted under said first means for filtering oil;

an outlet tube holder having a plurality of oil pass through holes permitting a flow of liquid refrigerant and oil to a lower portion of the accumulator;

a plurality of outlet tubes, each of said outlet tubes having a one end positioned under said second means permitting a flow of gaseous refrigerant and passing through said outlet tube holder and an other end projecting from the body; and an oil hole at a lower portion of the other end of each outlet tube, each said outlet tube operatively connected to a respective compressor of said plurality of compressors.

2. An air conditioner as claimed in claim 1, wherein said first means including a mesh with a plurality of holes for removing contaminants from oil flowing in through the inlet.

3. An air conditioner as claimed in claim 1, wherein said second means including a screen having a plurality of circumferential pass through holes under said first means for separating gaseous refrigerant from liquid refrigerant.

4. An air conditioner as claimed in claim 1, wherein the oil deposited in a lower portion of the accumulator is simultaneously or alternatively drawn to the compressors through each of said oil holes in said outlet tubes in proportion to flow rates of the refrigerant drawn to the compressors operatively depending on the required cooling/heating capacity.

5. An air conditioner comprising:

a plurality of compressors operative together or selectively depending on a required cooling/heating capacity for drawing, compressing, and discharging a refrigerant to heat exchangers, wherein said compressors include at least a first compressor and a second compressor, said second compressor having a larger compression capacity than a relatively smaller compression capacity of said first compressor;

a flow path controlling means for selecting a refrigerant flow path depending on a cooling/heating condition;

an outdoor heat exchanger connected between said flow path controlling means and an expansion valve which reduces a pressure of the refrigerant, for facilitating heat exchange between the refrigerant and a supply of external air;

an indoor heat exchanger connected between the expansion valve and said flow path controlling means for facilitating heat exchange between the refrigerant from the expansion valve and ambient air and evaporating the refrigerant; and, an accumulator for receiving a two phased refrigerant from the indoor and outdoor heat exchangers, separating gaseous refrigerant and oil from the two phased refrigerant flow, and permitting a flow of the gaseous refrigerant and oil to the compressors, said accumulator including a body having an inlet formed in a top portion thereof, said inlet connecting the flow path controlling means;

first means for filtering oil from contaminants being fitted near to the inlet in the body;

second means for separating the gaseous refrigerant from liquid refrigerant being fitted under said first means of the body; and a plurality of outlet tubes, each of said outlet tubes having a one end positioned under said second means an other end projecting from the body, and an oil hole at a lower portion thereof.

* * * * *